US007172152B2

(12) United States Patent
Wardell

(10) Patent No.: US 7,172,152 B2
(45) Date of Patent: Feb. 6, 2007

(54) PAPER TOWEL HOLDER AND DISPENSER

(76) Inventor: Janice W. Wardell, 12901 Jefferson Hwy., Apt. 912, Baton Rouge, LA (US) 70816

( * ) Notice: Subject to any disclaimer, the term of this patent is extended or adjusted under 35 U.S.C. 154(b) by 41 days.

(21) Appl. No.: 11/107,062

(22) Filed: Apr. 15, 2005

(65) Prior Publication Data

US 2006/0231673 A1 Oct. 19, 2006

(51) Int. Cl.
*B65H 16/04* (2006.01)

(52) U.S. Cl. ..... 242/597.7

(58) Field of Classification Search ..... 242/597.7, 242/130.2, 134, 141, 592, 398, 129, 400, 242/401, 405, 407, 407.1, 588, 597.8, 613; 221/45, 283; 248/693, 205.2; 211/118, 113, 211/85.5, 44, 45; 206/389, 392, 229, 407, 206/408

See application file for complete search history.

(56) References Cited

U.S. PATENT DOCUMENTS 1,034,939 A * 8/1912 Walker ..... 242/141
1,165,524 A * 12/1915 McKee ..... 242/597.7
1,169,967 A * 2/1916 Kent
1,191,733 A * 7/1916 Raymond ..... 242/134
2,098,477 A 11/1937 Welsh
3,987,979 A * 10/1976 Knispel ..... 242/141
4,345,788 A * 8/1982 Newton
4,796,939 A * 1/1989 Symonds et al.
4,811,548 A * 3/1989 Reist
4,946,212 A * 8/1990 Pruitt
5,098,055 A 3/1992 Leonian
5,692,639 A 12/1997 Lahaussois et al.
5,918,831 A * 7/1999 Floyd et al. ..... 242/597.7
6,270,035 B1 8/2001 Lahaussois
2004/0211694 A1* 10/2004 Coon et al. ..... 206/408
2005/0023229 A1* 2/2005 Ashley et al. ..... 211/118
2005/0127235 A1* 6/2005 McPherson ..... 242/597.7

* cited by examiner

*Primary Examiner*—William A. Rivera

(57) ABSTRACT

A paper towel holder and dispenser including a flat circular base plate having a top side and a bottom side with a first opening in the center thereof and a second opening near the outer edge thereof, a first cord extending upward from the bottom side of the base plate through the first opening and through the hollow central core of a roll of paper towels, a strip of hook and loop material connected to the upper end of the first cord, a second cord extending upward from the bottom side of the base plate through the second opening and around the outer surface of a roll of paper towels, and a loop connected to the second cord on the upper end of the second cord, the loop being adapted to receive the strip of hook and loop material connected to the upper portion of the first cord extending out of the end of the central hollow core.

9 Claims, 2 Drawing Sheets

PAPER TOWEL HOLDER AND DISPENSER

BACKGROUND OF THE INVENTION

1. Field of the Invention

The present invention relates to apparatus for holding a roll of paper towels. In particular, the invention relates to apparatus for holding and dispensing paper towels.

2. Description of the Related Art

A typical commercially available roll of paper towels is cylindrical in shape and has a central hollow cylindrical core former of paperboard or cardboard. Paper toweling is wound continuously around the hollow cylindrical core. Usually the toweling is provided with repetitive, spaced-apart lines of perforations to form lines of weakness to enable individual sheets or towels to be separated from the roll.

Paper towels are widely used throughout the world. Many homes have paper towel holding and dispensing devices permanently attached to the kitchen walls and cabinets. Such devices are commonly attached to the walls and cabinets of the kitchen of a home with screws or bolts.

Travelers frequently carry paper towel rolls on their travels. Hotel and motel rooms where the traveler is residing temporarily usually do not have paper towel holding and dispensing devices. Paper towel rolls used by the traveler must be placed on counter tops, tables, and on other flat surfaces in the room in which the traveler is temporarily residing. Such placement takes up space needed by the traveler. The paper towel rolls must be grasped in one hand and individual towels must be torn from the roll with the other hand.

There is therefore a need for a paper towel holder and dispenser that could be temporarily connected to a wall while the traveler is temporarily residing in a hotel or motel room, and removed from the wall when the traveler moves to another location.

Exemplary of the related art are the following U.S. Pat. Nos. 5,692,639; 6,270,035 B1; 5,098,055 and 2,098,477.

BRIEF SUMMARY OF THE INVENTION

In accordance with the present invention there is provided a paper towel holder and dispenser apparatus for holding and dispensing a cylindrical roll of paper towels having a first end and a second end and a central hollow cylindrical core with paper toweling wrapped continuously about the core, the central hollow core extending from the first end to the second end, the paper towel holder and dispenser apparatus including a flat circular base plate for supporting the first end of the cylindrical roll of paper towels, the flat circular base plate having a top side and a bottom side, the flat circular base plate having a first opening in the center thereof and a second opening near the outer edge thereof, the first opening and the second opening extending completely through the flat circular base plate from the top side to the bottom side of the plate, a first cord extending upward from the bottom side of the flat circular base plate through the first opening in the center of the circular base plate to the top side of the flat circular base plate, the first cord having a length sufficient to extend through the central hollow core from the first end to the second end and out of the second end of the central hollow core, a strip of hook and loop material connected to the portion of the first cord extending out of the second end of the central hollow core for connection to a strip of hook and loop material connected to a wall to suspend the paper towel holder and dispenser apparatus of the invention from a wall, a second cord extending upward from the bottom side of the flat circular base plate through the second opening of the circular base plate to the top side of the flat circular base plate, the first cord having a length sufficient to extend along the outer surface of the roll of paper towels from the first end to the second end and beyond the second end, and a loop connected to the second cord on the portion of the second cord extending beyond the second end, the loop being adapted to receive the strip of hook and loop material connected to the portion of the first cord extending out of the second end of the central hollow core.

The apparatus of the invention has the advantage of being low in cost.

The apparatus of the invention has the additional advantage of being easily connectable to the wall of a room.

The apparatus of the invention has a further advantage of being easily transportable by a traveler in a suitcase or other piece of luggage.

DETAILED DESCRIPTION OF THE INVENTION

Figure 1:
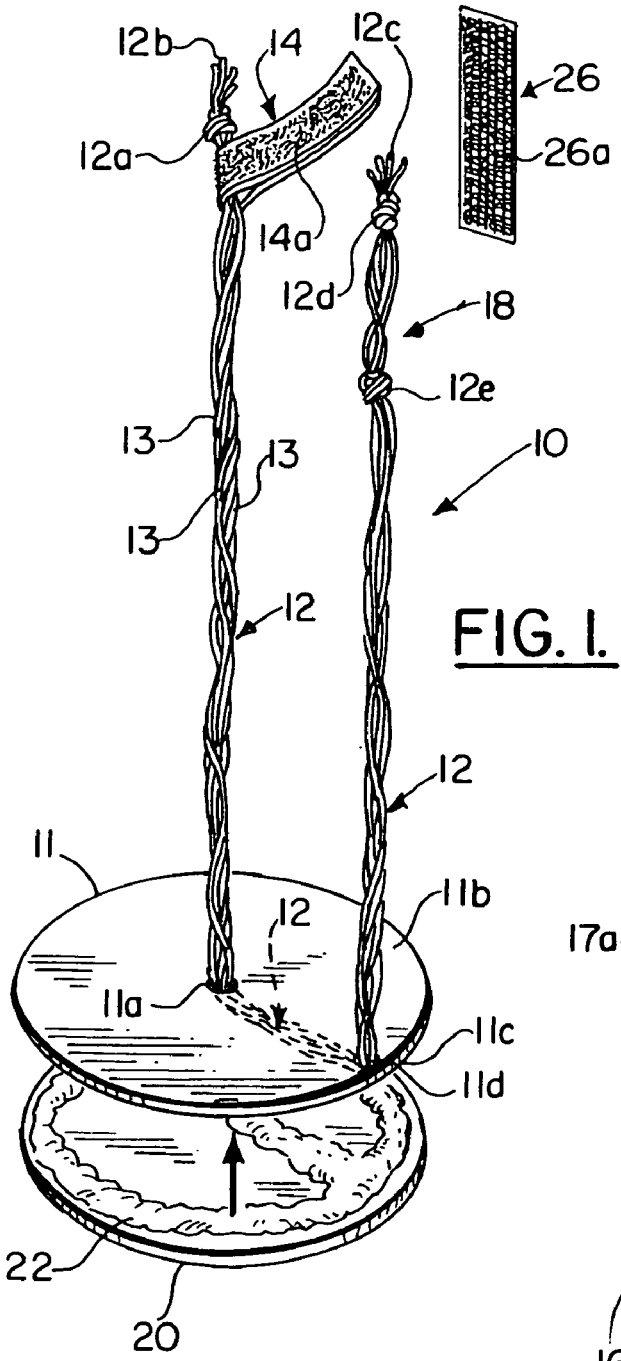
FIG. 1 is a partly exploded perspective view of the paper towel holder and dispenser of the invention.
Figure 2:
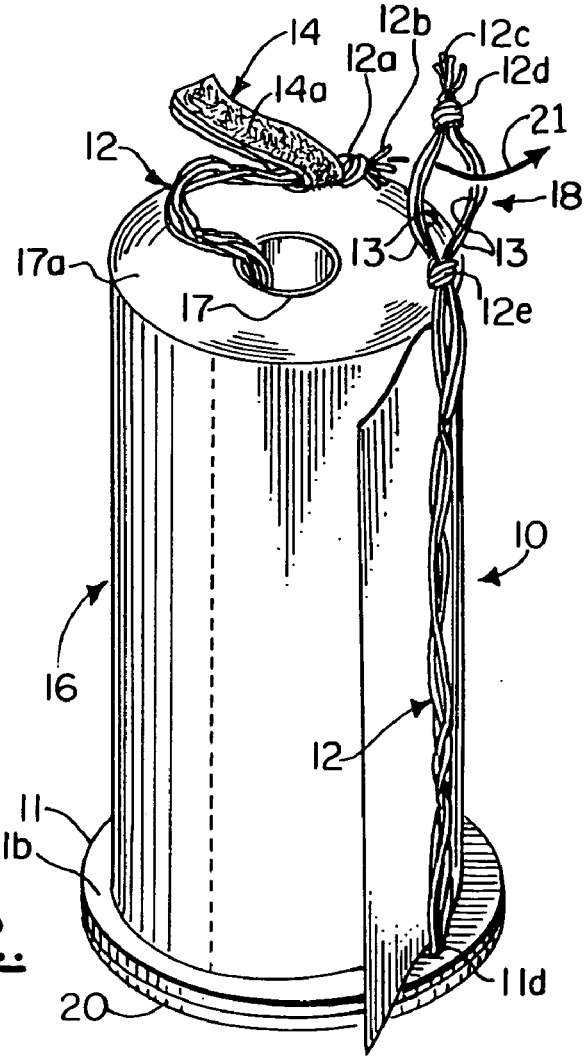
FIG. 2 is a perspective view of the paper towel holder and dispenser of FIG. 1 with a roll of paper towels connected thereto.
Figure 3:
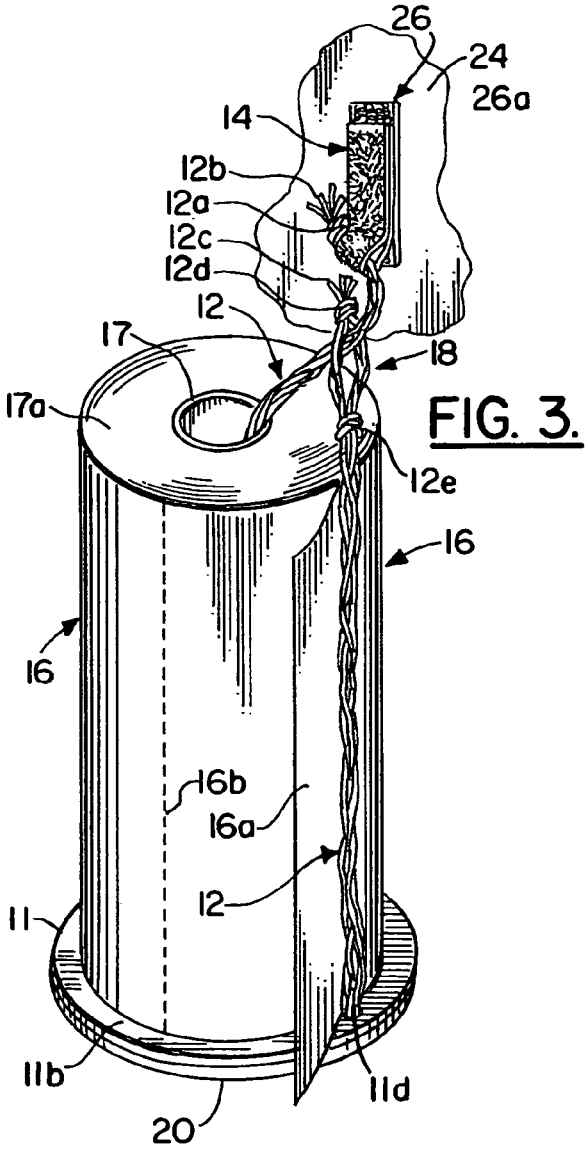
FIG. 3 is a perspective view of the paper towel holder and dispenser of FIG. 2 connected to a wall, the wall being show partly cut-away.

Referring now to the drawings, and in particular to FIGS. 1–3, the paper towel holder of the invention is generally indicated by the numeral 10. The paper towel holder and dispenser of the invention has a circular base plate 11. Circular base plate 11 is a flat circular disc constructed from a rigid material. The rigid materials from which circular base plate 11 may be constructed include polymeric materials commonly known in the art as plastics, cardboard, metal, or the like.

Circular base plate 11 has a circular opening 11*a* in the center thereof which extends completely through circular base plate 11 from the top side 11*b* of circular base plate 11 to the bottom side 11*c* of circular base 11. A flexible string or cord generally indicated by the numeral 12 extends through circular opening 11*a* in circular base plate 11. Cord 12 is preferably formed from a plurality of decorative strings 13 as shown in the drawings. Preferably, as shown in FIG. 2, there are four strings in cord 12, although cord 12 could utilize two strings only if desired.

At the upper end of cord 12 is a knot 12*a* tied in cord 12. A rectangular strip generally indicated by the numeral 14 of hook and loop fastening material or tape well known in the art such as Velcro® tape is wrapped around cord 12 beneath knot 12*a*. As is known in the art, Velcro® strip 14 has an adhesive material on one side thereof and either a hook or loop material 14*a* on the other side thereof. As shown in FIGS. 1–3, strip 14 is wrapped around cord 12 with the adhesive sides of strip 14 facing each other to bond the adhesive sides strip 14 together around the portion of cord 12 extending therethrough, thereby exposing either hook or loop material 14*a* on the surface of strip 14. Knot 12*a* prevents strip 14 from sliding past knot 12*a* and off of the upper end 12*b* adjacent to knot 12*a* of cord 12.

Cord 12 extends from opening 11*a* beneath circular base 11 to opening 11*d* near the outer edge of circular base plate 11. Opening 11*d* is spaced apart from opening 11*a* a distance equal at least to the radius of the cylindrical roll of paper towels generally indicated by the numeral 16 in FIGS. 2 and 3.

The roll of paper towels 16 is a typical, commercially available roll of paper towels having a hollow cylindrical core 17 formed of paperboard or similar material. Paper toweling 17*a* is wound continuously about the core 17. The portion of cord 12 beneath base plate 11 extending from opening 11*a* beneath circular base plate 11 to opening 11*d* near the outer edge of circular base plate 11 is indicated by phantom lines in FIG. 1.

Cord 12 extends through opening 11*d* upward along the outside surface to the roll of paper towels 16. Adjacent to the end 12*c* of cord 12 opposite from end 12*b* is a loop generally indicated by the numeral 18. Loop 18 is adapted to receive end 12*b* of cord 12 and strip 14 being placed therethrough as indicated by the arrow 20 in FIG. 2. Loop 18 is formed by tying two spaced apart knots 12*d* and 12*e* adjacent to the end 12*c* of cord 12. Knots 12*d* and 12*e* are spaced apart a distance sufficient to enable end 12*b* of cord 12 and strip 14 to pass between two pair of spaced apart strings 13—13 of loop 18 as shown in FIG. 2.

A second circular base plate 20 is connected to base plate 11 to securely hold the portion of cord 12 beneath the bottom 11*c* of base plate 11 between base plate 11 and second base plate 20. Adhesive 22 is shown in FIG. 1 on second base plate to connect second base plate 20 to circular base plate 11. If desired, second base plate 20 could be connected by any conventional means such as screwing, welding or the like.

To connect a roll of paper towels 16 to the paper towel holder and dispenser 10, strip 14 and the end 12*b* of cord 12 is inserted through hollow cylindrical core 17 of paper towel roll 16 and through loop 18 of cord 12. To suspend paper towel holder and dispenser 10 having a roll of paper towels 16 connected thereto to a wall 24 as shown in FIG. 3, a strip generally indicated by the numeral 26 of hook and loop fastening material or tape well known in the art such as Velcro® tape is connected to wall 24, and the surface of strip 14 is pressed against strip 26. To connect strip 26 to wall 24, the adhesive side of strip 26 is pressed against wall 24, causing strip 26 to adhere to wall 24.

The surface 26*a* of strip 26 has a hook or loop material thereon which will connect to the hook or loop material on the surface 14*a* of strip 14. Preferably surface 14*a* of strip 14 has loop material thereon, and the surface 26*a* of strip 26 has hook material thereon. However, if desired, surface 14*a* could have hook material thereon and surface 26*a* could have loop material thereon.

Conventional paper towel rolls well known in the art have a plurality of individual towels 16*a* separated by repetitive, spaced-apart parallel lines of weakness such as the line of perforations 16*b* shown in FIG. 3 to facilitate tearing individual towels 16*a* from the roll of paper towels 16. To remove an individual towel 16*a* from the roll of paper towels 16, the towel 16*a* is extended from the roll of paper towels as shown in FIG. 3 past the portion of cord 12 on the outside surface of the roll of paper towels 16. Preferably, towel 16*a* is extended sufficiently to place at least one of the lines of perforations 16*b* past the portion of cord 12 on the outside of the roll of paper towels 16. Towel 16*a* is then pulled away from the roll of paper towels 16 to force towel 16*a* against cord 12 and tear towel 16*a* from the roll of paper towels 16 along the line of perforations 16*b*.

Figure 4:
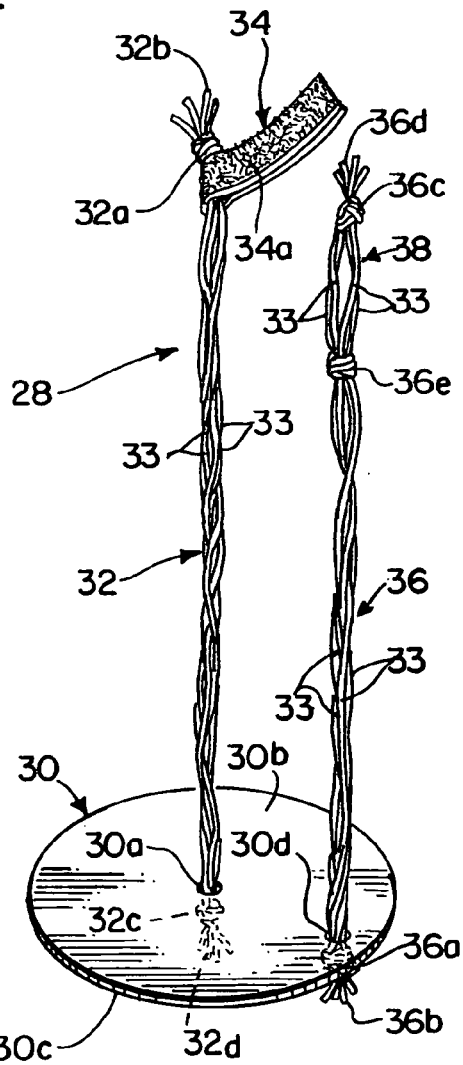
FIG. 4 is a perspective view of a second embodiment of the paper towel holder and dispenser of the invention.

In FIG. 4 is shown an alternate embodiment of the invention generally indicated by the numeral 28. Paper towel holder and dispenser 28 utilizes a single circular base plate generally indicated by the numeral 30. Circular base plate 30 is a circular disc constructed from a rigid material. The diameter of circular base plate 30 is at least equal to the diameter of the roll of paper towels 16. The rigid materials from which circular base plate 30 may be constructed include polymeric materials commonly known in the art as plastics, cardboard, metal, or the like.

Circular base plate 30 has a circular opening 30*a* therein which extends completely through the center of circular base plate 30 from the top side 30*b* of circular base plate 30 to the bottom side 30*c* of circular base 30. A flexible string or cord generally indicated by the numeral 32 extends through circular opening 30*a* in circular base plate 30. Cord 32 is preferably formed from a plurality of decorative strings 33 as shown in the drawings. Preferably, as shown in FIG. 2 for cord 12, there are four strings in cord 32, although cord 32 could have only two strings if desired.

At the upper end of cord 32 is a knot 32*a* tied in cord 32. A strip generally indicated by the numeral 34 of hook and loop fastening material or tape well known in the art such as Velcro® tape is wrapped around cord 32 beneath knot 32*a*. As is known in the art, Velcro® strip 34 has an adhesive material on one side thereof and either a hook or loop material 34*a* on the other side thereof. As shown in FIG. 4, strip 34 is wrapped around cord 32 with the adhesive sides of the strip 34 facing each other to bond strip 34 together around the portion of cord 32 extending therethrough, thereby exposing either hook or loop material 34*a* on the surface of strip 34. Knot 32*a* prevents strip 34 from sliding past knot 32*a* and off of the end 32*b* of cord 32.

Cord 32 extends through circular opening 30*a* beneath circular base 30. A knot or enlarged portion 32*c* is tied adjacent to the lower end 32*d* of cord 32 beneath circular base 30 to connect circular base 30 to cord 32 and prevent circular base 30 from sliding off of the lower end 32*d* of cord 32. Knot 32*c* is sufficiently large enough to prevent knot 32*c* from sliding through opening 30*a*.

Circular base plate 30 has a second circular opening 30*d* which extends completely through circular base plate 30 from the top side 30*b* of circular base plate 30 to the bottom side 30*c* of circular base 30. A flexible string or cord generally indicated by the numeral 36 extends upward through circular opening 30*d* in circular base plate 30. Cord 36 is preferably formed from a plurality of decorative strings 33 as shown in the drawings. Preferably there are four strings in cord 36.

A knot or enlarged portion 36*a* is tied adjacent to the lower end 36*b* of cord 36 beneath circular base 30 to connect circular base 30 to cord 36 and prevent circular base 30 from sliding off of the lower end 36*b* of cord 36. Knot 36*c* is sufficiently large enough to prevent knot 36*c* from sliding through opening 30*a*.

At the upper end of cord 36 is a knot 36*c* tied in cord 36. Adjacent to the upper end 36*d* of cord 36 opposite from lower end 36*b* is a loop generally indicated by the numeral 38 formed by separating two pair of strings 33 as shown in FIG. 2 for the first embodiment of the invention generally indicated by the numeral 10. Loop 38 is adapted to receive end 32*b* of cord 32 and strip 34 being placed through loop 38 similarly to FIG. 2. Loop 38 is formed by tying two spaced apart knots 36*c* and 36*e* in cord 36 adjacent to the upper end 36*d* of cord 36. Knots 36*c* and 36*e* are spaced apart a distance sufficient to enable end 32*b* and strip 34 to pass between two pair of spaced apart strings 33—33 of loop 38 similarly to FIG. 2.

To connect a roll of paper towels 16 to the paper towel holder and dispenser 28, strip 34 and the end 32*b* of cord 32 is inserted through hollow cylindrical core 17 of paper towel roll 16 and through loop 38 in cord 36. To suspend paper towel holder and dispenser 28 having a roll of paper towels 16 connected thereto to a wall 24 as shown in FIG. 3 for paper towel holder and dispenser 10, a strip generally indicated by the numeral 26 of hook and loop fastening material or tape well known in the art such as Velcro® tape is connected to wall 24, and the surface of strip 34 is pressed against strip 26. To connect strip 26 to wall 24, the adhesive side of strip 26 is pressed against wall 24, causing strip 26 to adhere to wall 24. The surface 26*a* of strip 26 has a hook or loop material thereon which will connect to the hook or loop material on the surface 34*a* of strip 34. Preferably surface 34*a* of strip 34 has loop material thereon, and the surface 26*a* of strip 26 has hook material thereon. However, if desired, surface 34*a* could have hook material thereon and surface 26*a* could have loop material thereon.

If desired, knots 12*a*, 12*d*, 12*e*, 32*a*, 32*c*, 36*a*, 36*c* and 36*e* could be replaced with conventional fasteners known in the art such as clamps or beads well known in the art.

Although the preferred embodiments of the invention have been described in detail above, it should be understood that the invention is in no sense limited thereby, and its scope is to be determined by that of the following claims:

What is claimed is:

1. A paper towel holder and dispenser apparatus for holding and dispensing a cylindrical roll of paper towels having a first end and a second end and a central hollow cylindrical core with paper toweling wrapped continuously about said core, said central hollow core extending from said first end to said second end, said paper towel holder and dispenser apparatus comprising:

a. a flat circular base plate for supporting said first end of said cylindrical roll of paper towels, said flat circular base plate having a top side and a bottom side, said flat circular base plate having a first opening in the center thereof and a second opening near the outer edge thereof, said first opening and said second opening extending completely through said flat circular base plate from said top side to said bottom side, b. a first cord extending upward from said bottom side of said flat circular base plate through said first opening in the center of said circular base plate to the top side of said flat circular base plate, said first cord having a length sufficient to extend through said central hollow core from said first end to said second end and out of said second end of said central hollow core, c. a strip of hook and loop material connected to the portion of said first cord extending out of said second end of said central hollow core for connection to a strip of hook and loop material connected to a wall to suspend said apparatus from a wall, d. a second cord extending upward from said bottom side of said flat circular base plate through said second opening of said circular base plate to the top side of said flat circular base plate, said first cord having a length sufficient to extend along the outer surface of said roll of paper towels from said first end to said second end and beyond said second end, and e. a loop connected to said second cord on the portion of said second cord extending beyond said second end, said loop being adapted to receive said strip of hook and loop material connected to the portion of said first cord extending out of said second end of said central hollow core.

2. The apparatus of claim 1 wherein said first cord extending upward from said bottom side of said flat circular base plate through said first opening in the center of said circular base plate to the top side of said flat circular base plate is connected to said bottom side of said flat circular base plate.

3. The apparatus of claim 2 wherein said first cord extending upward from said bottom side of said flat circular base plate is connected to said circular base plate by an enlarged portion in said first cord, said enlarged portion in said cord being sufficient large enough to prevent said enlarged portion from sliding through said first opening in said flat circular base plate.

4. The apparatus of claim 3 wherein said enlarged portion is a knot tied in said first cord.

5. The apparatus of claim 2 wherein said first cord extending upward from said bottom side of said flat circular base plate is connected to said circular base plate by a second base plate connected to said bottom side of first flat circular base plate.

6. The apparatus of claim 5 wherein said second cord extending upward from said bottom side of said flat circular base plate is connected to said circular base plate by an enlarged portion in said second cord, said enlarged portion in said cord being sufficient large enough to prevent said enlarged portion from sliding through said first opening in said flat circular base plate.

7. The apparatus of claim 6 wherein said enlarged portion is a knot tied in said second cord.

8. The apparatus of claim 5 wherein said second cord extending upward from said bottom side of said flat circular base plate is connected to said circular base plate by a second base plate connected to said bottom side of first flat circular base plate.

9. The apparatus of claim 1 wherein said first opening is spaced apart from said second opening a distance at least equal to the radius of said cylindrical role of paper towels.

* * * * *